US006340516B1

(12) United States Patent
Shih et al.

(10) Patent No.: US 6,340,516 B1
(45) Date of Patent: Jan. 22, 2002

(54) INK JET RECORDING MATERIALS

(75) Inventors: Shu-Chu Shih, Hsinchu; Charng-Shing Lu, Tainan Hsien; Jing-Pin Pan, Hsinchu Hsien, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/240,797

(22) Filed: Jan. 30, 1999

(51) Int. Cl.[7] ..... B41M 5/00; B05D 5/04
(52) U.S. Cl. ..... 428/195; 428/522; 428/532
(58) Field of Search ..... 428/532, 522, 428/195

(56) References Cited

U.S. PATENT DOCUMENTS 5,888,635 A * 3/1999 Yang et al. ..... 428/195
6,096,418 A * 8/2000 Sato et al. ..... 428/195
6,214,417 B1 * 4/2001 Watanabe et al. ..... 428/311.11

* cited by examiner

*Primary Examiner*—Pamela R. Schwartz
(74) *Attorney, Agent, or Firm*—W. Wayne Liauh

(57) ABSTRACT

The present invention relates to ink jet recording materials and method for making the same. The material has a gel layer formed on a base material to improve the optical density of the material and improve the printing quality of ink of pigment type. The method for forming the gel layer is to coat a first ink-receptive layer composed of high valance metallic halide, such as calcium chloride ($CaCl_2$) or magnesium chloride ($MgCl_2$), on the base layer, then a second ink-receptive layer composed of alginate, such as sodium alginate, potassium alginate or other compounds of alginic acid, on the first ink-receptive layer. The second and the first ink-receptive layers will react to form a gel layer during coating for absorbing ink dots and improving print quality.

13 Claims, 1 Drawing Sheet

INK JET RECORDING MATERIALS

BACKGROUND OF THE INVENTION

The present invention relates to ink jet recording materials and method for making the same. The material has a gel layer formed on a base material to improve the printing quality of ink of black pigment type.

Ink jet printers are fast developing in resent years. Meanwhile, the technologies for ink and recording materials are continuously improving. Generally, ink can be classified into two categories as dye type and pigment type. The manufacturing of recording material is to coat an ink-receptive layer on a base layer, such as paper. The ink-receptive layer will fast absorb ink droplets when the ink droplets are jetted from a print head to the recording material. Only when each ink droplet is even and fast absorbed, no spreading, feathering or penetration occur, the good quality of printing can be achieved. But due to the compatibility of a specific ink to its suitable recording materials, the ink and the ink-receptive layer of a recording material have to be well designed.

To determine if a recording material is suitable for an ink, an index of optical density of the material can be checked. The optical density is the reflection density of an ink jet image on the recording material. A higher optical density means a lower reflection, the ink is well absorbed on the material without cleavage or small holes, and a better print quality is obtained. On the contrary, a lower optical density means poor ink absorbency of the material, cleavages or holes occur in the ink dots, the print color is not true, and the print quality is poor.

Regarding to using pigment type ink, a recording material disclosed in U.S. Pat. No. 5,643,631 is made with an ink-receptive layer of precipitated calcium carbonate and a binder on a base layer. The ink-receptive layer will absorb the ink and prevent it from color mixing, feathering, unevenness or cleavages in order to obtain better print quality. The material according to 5,643,631 patent has been tested its optical density of image printed by an HP printer and tested on a reflection densitometer. The result is listed as in TABLE 1 in which four recording materials A, B, C and D are made of different ratios of precipitated calcium carbonate and a binder.

TABLE 1

| Prior Arts Recording Materials | Optical Density |
|---|---|
| A | 0.98 |
| B | 1.22 |
| C | 1.14 |
| D | 1.02 |

As shown in TABLE 1, the optical density of material according to 5,643,631 patent are in the range of 0.98 to 1.22 which are not quite high. That means the ink absorbency and drying speed are not good enough for achieving the high print quality demand today. Especially for high speed printing, when more ink drops jetted on the recording material in a short time, the material has to absorb and dry the ink drops quickly, and, most importantly, grab all the ink drops firmly without generating cleavages or holes. Therefore, for obtaining a better print quality, the optical density of a recording material has to be raised.

The object of the present invention is therefore to provide a recording material for using on an ink jet printer or ink jet modem which has a suitable higher optical density for improving print quality of ink of pigment type.

According to the present invention, an ink jet recording material has a gel layer formed on a base material to improve the optical density of the material and improve the printing quality of ink of pigment type. The method for forming the gel layer is to coat a first ink-receptive layer composed of high valance metallic halide, such as calcium chloride ($CaCl_2$) or magnesium chloride ($MgCl_2$), on the base layer, then a second ink-receptive layer composed of alginate, such as sodium alginate, potassium alginate or other compounds of alginic acid, on the first ink-receptive layer. The second and the first ink-receptive will react to form a gel layer during coating the second layer.

The objectives and advantages of the present invention will become apparent from a detailed description provided below, with reference to the accompanying drawings.

TABLE 1 a record of optical density of recording materials of prior arts;

TABLE 2 is a composition of a first ink-receptive layer of the present invention;

TABLE 3 is a composition of binder of 30% polymethyl methacrlyate according to the present invention; and TABLE 4 is a record of optical density of recording materials of the present invention.

DETAILED DESCRIPTION OF PREFERRED EMBODIMENTS

Figure 1:
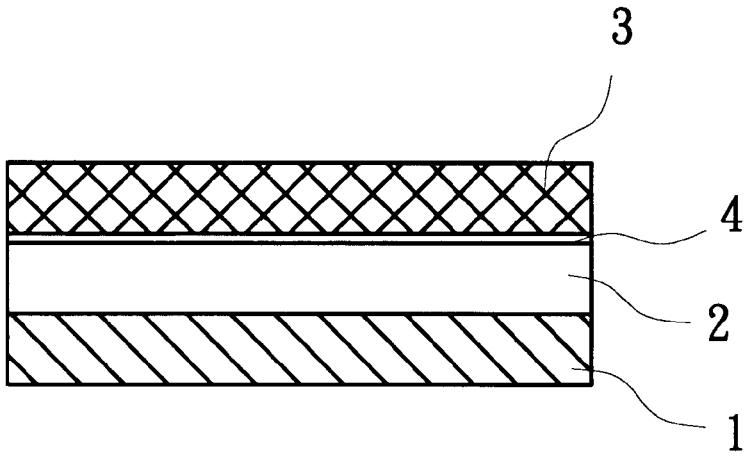
FIG. 1 is a cross-sectional view of an ink jet recording material according to a first embodiment of the present invention.
Figure 2:
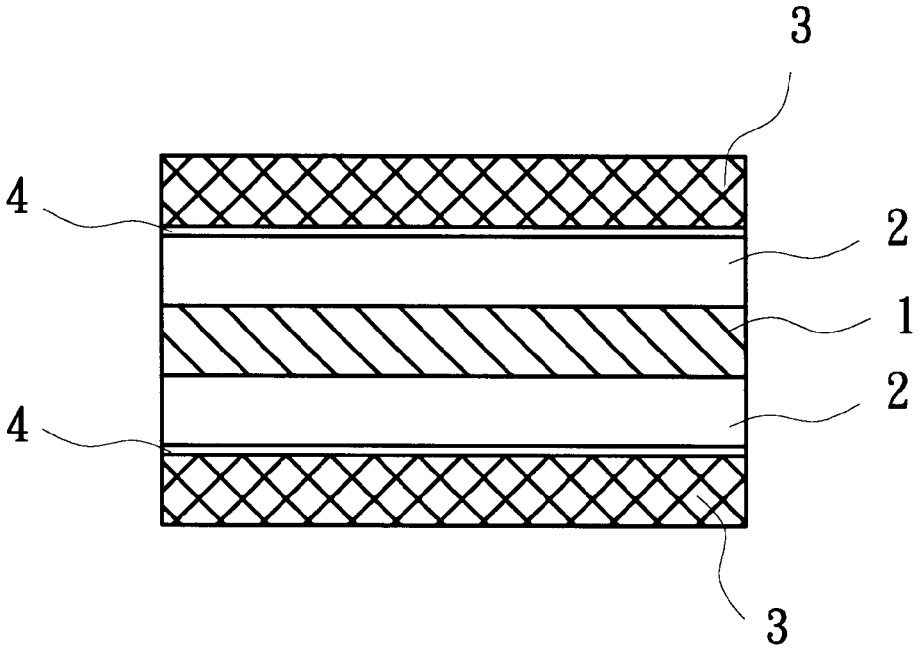
FIG. 2 is a cross-sectional view of an ink jet recording material according to a second embodiment of the present invention.

Referring to FIG. 1 and FIG. 2, cross-sectional views of ink jet recording materials according to the present invention are illustrated. As shown in FIG. 1, an ink jet recording material has a base material 1, a first ink-receptive layer 2, a second ink-receptive layer 3 and a gel layer 4. The base material is of paper, transparent film, fiber or any composition from them. The composition of the first ink-receptive layer 2 is listed in TABLE 2 which includes the major ingredients as follows for improving print quality.

1) Polyvinylpyrrolidone (PVP) of 0.5 to 5 percent by weight. The molecular weight of the polyvinylpyrrolidone is around $8*10^3$ to $2.9*10^6$;

2) Polyvinyl alcohol (PVA) of 1 to 5 percent by weight. The molecular weight of the polyvinyl alcohol is around $1*10^4$ to $1*10^5$;

3) Hydroxyethanolcellulose (HEC) of 1 to 10 percent by weight;

4) Metallic halide, such as calcium chloride ($CaCl_2$) of 0.1 to 1 percent by weight; and 5) Polymethyl methacrlyate (PMMA) of 0.1 to 1 percent by weight.

TABLE 2

| Ingredients | Average Molecular Weight | Percentage by Weight |
|---|---|---|
| Polyvinylpyrrolidone (PVP) | $8 * 10^3 \sim 2.16 * 10^5$ | 0.5~5 |
| Polyvinylpyrrolidone (PVP) | $6.3 * 10^3 \sim 2.9 * 10^6$ | 0.5~5 |
| Polyvinyl alcohol (PVA) | $1 * 10^4 \sim 1 * 10^5$ | 1~15 |

TABLE 2-continued

| Ingredients | Average Molecular Weight | Percentage by Weight |
|---|---|---|
| Methyl methacrylate (MMA) | — | 0~2 |
| Triethanolamine | — | 0~1 |
| Hydroxyethanolcellulose (HEC) | — | 1~10 |
| Nonionic surfactant | — | 0~1 |
| Calcium chloride ($CaCl_2$) | — | 0~5 |
| Polymethyl methacrlyate (PMMA) | — | 0~1 |

The other ingredients of 30 percent methyl methacrylate (MMA), triethanolamine and nonionic surfactant in TABLE 2 are used as supplementary materials for improving the characteristics, such as viscosity, uniformity and interface properties, of the compound and improving the print quality. The composition of the MMA (as PMMA binder) is listed in TABLE 3.

TABLE 3

| Ingredients | Percentage by Weight | Usage |
|---|---|---|
| Azo-bis-isobuty onitrile (AIBN) | 0.5–5 | Initializer |
| 1-Dodecanthiol | 0.7–5 | Bond transferor |
| Methyl Methacrylic acid (MMA) | 15–25 | Reactor |
| 2-HEMA | 15–25 | Reactor |

The composition of the second ink-receptive layer 3 is similar to the first ink-receptive layer 2 and includes the major ingredients as follows for improving print quality.

a) Alginate of 0.1 to 1 percent by weight;

b) Polyvinylpyrrolidone (PVP) of 0.5 to 5 percent by weight. The molecular weight of the polyvinylpyrrolidone is around $8*10^3$ to $2.9*10^6$;

c) Polyvinyl alcohol (PVA) of 1 to 5 percent by weight. The molecular weight of the polyvinyl alcohol is around $1*10^4$ to $1*10^5$; and d) Hydroxyethanolcellulose (HEC) of 1 to 10 percent by weight.

The other ingredients such as 30 percent methyl methacrylate (MMA), triethanolamine and nonionic surfactant are used for improving the characteristics, such as viscosity, uniformity and interface properties, of the compound of second ink-receptive layer 3.

The main point of the invention is the gel layer 4 which is formed by complex reaction of the metallic halide in the first ink-receptive layer 2 and the alginate in the second ink-receptive layer 3. The gel layer 4 is formed at the boundary of the first 2 and second layer 3, which further improve the properties of ink absorbency, fast drying and ink firmness of the recording material, raise the optical density, and improve the print quality for ink of pigment type.

The manufacturing process of the recording material of the present invention is as follows:

1) Composing a first ink-receptive layer 2 which includes high valance metallic halide;
2) Composing a second ink-receptive layer 3 which includes alginate;
3) Coating uniformly the first ink-receptive layer 2 with a thickness 1 of to 20 micrometers on a surface of a base material 1 having thickness of around 100 to 180 micrometers;
4) Drying the first ink-receptive layer 2 on a surface of the base material 1 under temperature of 140 degree centigrade. The preferred drying time is 2 to 5 minutes;
5) Coating uniformly the second ink-receptive layer 3 with a thickness of 1 to 5 micrometers on surface of the first ink-receptive layer 2;
6) Drying the second ink-receptive layer 3 under temperature of 140 degree centigrade. The preferred drying time is 2 to 5 minutes.

In the aforesaid process, the thickness ratio of the first ink-receptive layer 2 to the second ink-receptive layer 3 is preferred of a range within 2:1 to 20:1. The total thickness of the first ink-receptive layer 2 and the second ink-receptive layer 3 is preferred of 5 to 25 micrometers.

The first ink-receptive layer 2 and the second ink-receptive layer 3 can also be coated on both sides of the base material 1 as shown in FIG. 2.

Since the reaction between the high valance metallic halide and the alginate is very strong, when the second ink-receptive layer 3 coating on the first ink-receptive layer 2, the metallic halide in the first ink-receptive layer 2 will quickly react with the alginate in the second ink-receptive layer 3 and forms the gel layer 4. The gel layer 4 is a compound formed by the metallic ions $Mn^{+n}$ of the metallic halide covering on the alginate. The gel layer 4 has great performance of ink absorbency and fast drying. Therefore, when ink drops jetting on the recording material, they will be quickly absorbed, dried and grabbed by the gel layer 4 without forming cleavages or holes, and the better print quality can be obtained.

The aforesaid reaction of metallic halide and alginate is self-achieved without needs of additional energy or other supplementary agents. So, we just have to coat the first ink-receptive layer 2 and the second ink-receptive layer 3 on the base material 1 sequentially, then the gel layer 4 can be obtained in a short time period.

The manufacturing processes and compositions of four preferred embodiments of the present invention will be described below.

First Embodiment

The coating thickness and drying conditions of a first embodiment is as follows:

The thickness of the first ink-receptive layer 2 is 20 micrometers; the drying condition is 140 degree centigrade and 3 minutes. The thickness of the second ink-receptive layer 3 is 5 micrometers; the drying condition is 140 degree centigrade and 3 minutes.

The manufacturing processes of the first ink-receptive layer 2 and the second ink-receptive layer 3 are respectively described below.

A. The manufacturing process of the first ink-receptive layer 2 includes the following steps:

1) Having 87.04 grams of polyvinylpyrrolidone (PVP) with average molecular weight of $9*10^3$ totally dissolved in 45 grams of ethanol and 560 grams of water, then 28 grams of polyvinyl alcohol (PVA) with average molecular weight of $6.3*10^5$ is added and stirred uniformly into a solution A;
2) Having 460 grams of polyvinyl alcohol (PVA) with average molecular weight of $8.8*10^4$ added with 460 grams of ethanol and 1840 grams of water (or ice?), stirred uniformly under room temperature for half an hour, then heated to temperature of 60+/−10 centigrade and stirred till totally dissolved. After cooled down to room temperature, the solute is added with the solution A into a solution B;
3) Having 460 grams of hydroxytheyl cellulose (HEC) added with 106 grams of ethanol and 848 grams of water, stirred uniformly under room temperature for half an hour, then heated to temperature of 60+/−10 centigrade and stirred till totally dissolved. After cooled down to room temperature, the solution is added with the solution B into a solution C;

4) Mixing uniformly 20 grams of 30% methyl methacrylate (MMA, PMMA binder), 620 grams of ethanol and 6.4 grams of triethanolamine and adding with the solution C into a solution D;

5) Having 460 grams of polymethyl methacrlyate (PMMA) added with 30 grams of ethanol, stirred uniformly and added with the solution D into a solution E;

6) Having $1.76*10^{-3}$ grams of nonionic surfactant added with 28 grams of ethanol and 9 grams of water, and added with the solution E into a solution F;

7) Having 75 grams of high valance metallic halide, such as calcium chloride ($CaCl_2$), magnesium chloride ($MgCl_2$) or other metallic halide, added with 340 grams of water and the solution F into the composition of the first ink-receptive layer.

The methyl methacrylate (MMA, PMMA binder) in step 4 is made by the following procedure:

Using 312 grams of methyl methacrylic acid (MAA), 312 grams of 2-HEMA and 416 grams of methyl methacrlyate (MMA) as reactors, 10 grams of 1-Dodecanthiol as bond transferor and 10 grams of azo-bis-isobutyronitrile (AIBN) as initializer. Then adding 1560 grams of propylene glycol monomethyl ether (PM) as solute, and reacting for three hours under temperature of 100 centigrade.

B. The manufacturing process of the second ink-receptive layer 3 includes the steps of mixing uniformly 12 grams of sodium alginate, or potassium alginate, with 100 grams of ethanol and 888 grams of water; then adding it with 700 grams of the solution F, as described in step 6 for making the first ink-receptive layer 2, and stirring uniformly into the compound for second ink-receptive layer 3.

Second Embodiment

The second embodiment differs from the first embodiment only at the composition of the second ink-receptive layer 3 while the thicknesses and drying conditions of the layer 2 and layer 3 are the same. The second ink-receptive layer 3 is made by the steps of mixing uniformly 15.6 grams of sodium alginate, or potassium alginate, with 100 grams of ethanol and 884 grams of water; then adding it with 644 grams of the solution F, as described in step 6 for making the first ink-receptive layer 2, and stirring uniformly into the compound for second ink-receptive layer 3.

Third Embodiment

The third embodiment differs from the second embodiment only at the thickmesses of the first and the second ink-receptive layers 2 and 3 while drying conditions are the same. The thickness of the first ink-receptive layers 2 is 18 micrometers, and the thickness of the second ink-receptive layers 3 is 7 micrometers.

Fourth Embodiment

The fourth embodiment differs from the first embodiment only at the thicknesses of the first and the second ink-receptive layers 2 and 3 while drying conditions are the same. The thickness of the first ink-receptive layers 2 is 20 micrometers, and the thickness of the second ink-receptive layers 3 is 1 micrometers.

For testing the print quality of the materials of the invention, the materials from the aforesaid four embodiments are used on an HP printer (HP 870) with a specific test pattern, then measured by a spectrometer for calculating optical densities. The results are listed in TABLE 4. The optical density (OD) is calculated from the equation:

$$OD=-\log T_{max}$$

in which $T_{max}$ is the maximum transparency rate for the wavelength within 400 to 700 nanometers.

The area of test pattern in this invention is 1 cm*1 cm, the ink is black. The transparency rate $T_{max}$ is measured by an UV-Visible spectrometer (Hitachi U-2000 UV-VISIBLE) then calculated into optical density.

TABLE 4

| | Optical Density |
|---|---|
| First Embodiment | 2.2 |
| Second Embodiment | 2.7 |
| Third Embodiment | 1.68 |
| Fourth Embodiment | 2.7 |
| Prior Arts Material | 0.98~1.22 |

The optical densities of materials of prior arts, as listed in TABLE 1 taken from U.S. Pat. No. 5,643,631, are within 0.98 to 1.22, while the optical densities of the materials of the present invention, as listed in TABLE 4, are within 1.68 to 2.7. Especially for the preferred second and fourth embodiments, the optical densities are 2.7 which are 2.2 times to that of the material of U.S. Pat. No. 5,643,631. It is obvious that the properties of ink absorbency, ink firmness and drying speed of the invented materials are higher than that of traditional materials. It improves the print quality and makes the print image with true and uniform color without cleavages or small holes in the print dots.

By study of the test result, it is found that under a certain composition of the first ink-receptive layer 2, a higher ratio of the sodium alginate in second ink-receptive layer 3 relative to the solution F will make a higher optical density. And, a less thickness of the second ink-receptive layer 3 will make a higher optical density also. Therefore, we may adjust the aforesaid ratios to get a desired optical density of the material.

The advantages of the present invention are:

1) The present invention provides an ink jet recording materials and its manufacturing process. The recording material is made by coating two ink-receptive layers on a base material. The two layers will react to form a gel layer which will improve the ink absorbency, drying speed, water fastness and optical density of the material, therefore improve the print quality.

2) Since the reaction of the gel layer from metallic halide and alginate is self-achieved without needs of additional energy or other supplementary agents. So, the manufacturing cost is lower and procedures are simpler.

3) Since the optical density of the material can be adjusted from the composition ratio of the first and the second ink-receptive layers and the thickenesses of the layers, it is easy to adjust the material for any suitable optical density and meets the requirement of print quality.

Although the invention has been described in connection with preferred embodiments, it will be understood by those skilled in the art that various changes may be made without departing from its scope.

We claim:

1. An ink jet recording material formed by a process which comprises the following steps:

coating a base material with a first ink-receptive layer comprising a high valence metallic halide which is capable of reacting with an alginate; and coating the surface of said first ink-receptive layer with a second ink-receptive layer comprising an alginate so as to generate a gel layer at the interface between said first ink-receptive layer and said second ink-receptive layer;

wherein said first ink-receptive layer comprises:

(a) polyvinylpyrrolidone of 0.5 to 5 percent by weight, said polyvinylpyrrolidone having a molecular weight of about $8*10^3$ to $2.9*10^6$;

(b) polyvinyl alcohol of 1 to 15 percent by weight, said polyvinylpyrrolidone having a molecular weight of about $1*10^4$ to $1*10^5$; and (c) hydroxyethyl cellulose of 1 to 10 percent by weight.

2. An ink jet recording material according to claim 1 wherein said high valance metallic halide is an alkaline-earth metallic halide.

3. An ink jet recording material according to claim 2 wherein said alkaline earth metallic halide is selected from the group consisting of calcium chloride and magnesium chloride.

4. An ink jet recording material according to claim 1 wherein said alginate is selected from the group consisting of sodium alginate and potassium alginate.

5. An ink jet recording material according to claim 1 wherein said first ink-receptive layer further comprises:

(a) methyl methacrylic acid of 15 to 25 percent by weight;

(b) 2-HEMA of 15 to 25 percent by weight;

(c) azo-bis-isobutyronitrile of 0.5 to 5 percent by weight; and (d) 1-dodecanthiol of 0.7 to 5 percent by weight.

6. An ink jet recording material according to claim 1 wherein said first ink-receptive layer further comprises triethanolamine of 0.1 to 1 percent by weight.

7. An ink jet recording material according to claim 1 wherein the ratio of thickness of said first ink-receptive layer to said second ink-receptive layer is in the range of 2:1 to 20:1.

8. An ink jet recording material formed by a process which comprises the following steps:

coating a base material with a first ink-receptive layer comprising a high valence metallic halide which is capable of reacting with an alginate; and coating the surface of said first ink-receptive layer with a second ink-receptive layer comprising an alginate so as to generate a gel layer at the interface between said first ink-receptive layer and said second ink-receptive layer;

wherein said second ink-receptive layer comprises:

(a) alginate of 0.1 to 1 percent by weight;

(b) polyvinylpyrrolidone of 0.5 to 5 percent by weight, wherein the molecular weight of said polyvinylpyrrolidone is about $8*10^3$ to $2.9*10^6$;

(c) polyvinyl alcohol of 1 to 5 percent by weight, wherein the molecular weight of said polyvinyl alcohol is about $1*10^4$ to $1*10^5$; and (d) hydroxyethyl cellulose of 1 to 10 percent by weight.

9. An ink jet recording material according to claim 8 wherein said second ink-receptive layer further comprises a polymethyl methacrylate binder of 0.1 to 2 percent by weight, said binder comprises:

(a) methyl methacrylic acid of 15 to 25 percent by weight;

(b) 2-HEMA of 15 to 25 percent by weight;

(c) azo-bis-isobutyronitrile of 0.5 to 5 percent by weight; and (d) 1-dodecanthiol of 0.7 to 5 percent by weight.

10. An ink jet recording material according to claim 8 wherein said second ink-receptive layer further comprises triethanolamine of 0.1 to 1 percent by weight.

11. An ink jet recording material according to claim 8 wherein the ratio of thickness of said first ink-receptive layer to said second ink-receptive layer is in the range of 2:1 to 20:1.

12. An ink jet recording material according to claim 8 wherein the total thickness of said first ink-receptive layer and said second ink-receptive layer is in the range of 5 to 25 micrometers.

13. An ink jet recording material according to claim 8 wherein the total thickness of said first ink-receptive layer and said second ink-receptive layer is in the range of 5 to 25 micrometers.

* * * * *